United States Patent [19]

Sugioka

[11] Patent Number: 4,685,629

[45] Date of Patent: Aug. 11, 1987

[54] MONITOR OF ABNORMALITY IN A YARN WINDING APPARATUS

[75] Inventor: Takami Sugioka, Matsuyama, Japan

[73] Assignee: Teijin Seiki Co., Ltd., Osaka, Japan

[21] Appl. No.: 845,886

[22] Filed: Mar. 28, 1986

[30] Foreign Application Priority Data

| | | | |
|---|---|---|---|
| Mar. 28, 1985 | [JP] | Japan | 60-64783 |
| Mar. 28, 1985 | [JP] | Japan | 60-64784 |
| Mar. 28, 1985 | [JP] | Japan | 60-64785 |
| Mar. 28, 1985 | [JP] | Japan | 60-64786 |

[51] Int. Cl.[4] ..... B65H 54/00; B65H 63/00; B65H 67/048

[52] U.S. Cl. ..... 242/18 R; 242/18 A; 242/18 DD:36; 242/45

[58] Field of Search ..... 242/18 A, 45, 36, 18 R, 242/18 DD

[56] References Cited

U.S. PATENT DOCUMENTS

| | | | |
|---|---|---|---|
| 3,180,584 | 4/1965 | Blunck et al. | 242/45 |
| 3,536,272 | 10/1970 | Ueyama | 242/45 |
| 3,717,311 | 2/1973 | Smith | 242/45 X |
| 3,860,187 | 1/1975 | Liska et al. | 242/45 |
| 3,931,938 | 1/1976 | Hasegawa et al. | 242/45 |
| 4,049,211 | 9/1977 | Spescha | 242/45 |
| 4,069,985 | 1/1978 | Lohest et al. | 242/45 |
| 4,245,794 | 1/1981 | Hasegawa et al. | 242/45 |
| 4,307,848 | 12/1981 | Barathieu | 242/18 R |
| 4,458,849 | 7/1984 | Miyake et al. | 242/36 |
| 4,494,702 | 1/1985 | Miyake et al. | 242/45 X |
| 4,566,642 | 1/1986 | Sommer et al. | 242/36 X |

*Primary Examiner*—Stanley N. Gilreath
*Attorney, Agent, or Firm*—Burgess, Ryan & Wayne

[57] ABSTRACT

An apparatus for monitoring abnormality in a yarn winding apparatus, which is characterized by a means for previously setting a basic value of a winding factor, a means for detecting a present value of winding factor, a means for comparing the present value of winding factor detected by the winding factor detecting means with the basic value set by the basic value previously setting means, and a means for emitting an alarm signal when the detected present value of winding factor exceeds more than a set range from the set basic value as a result of comparison in the comparing means.

11 Claims, 6 Drawing Figures

MONITOR OF ABNORMALITY IN A YARN WINDING APPARATUS

BACKGROUND OF THE INVENTION

1. Field of the Invention

The present invention relates to a yarn winding apparatus. More particularly, the present invention relates to an apparatus for monitoring abnormality in a yarn winding apparatus.

The apparatus for monitoring abnormality according to the present invention is especially suitable for a yarn winding apparatus for winding at a high speed a spun thermoplastic synthetic yarn, such as, polyester or polyamide.

2. Description of Prior Art

When a yarn is wound onto a bobbin by means of a yarn winding apparatus, there may occur deformation of ribboning, inward movement or uneveness in the wound yarn quality. In the deformation of ribboning, ribboning formed when the wind ratio nears a certain integer is deformed by the pressing of the contact roller. In the inward movement of wound yarn, the wound yarn moves toward the longitudinal center of a package due to variations of pressing force between the contact roller and the bobbin or the yarn layer formed on the bobbin. The uneveness in the wound yarn quality occurs due to variations of the tension in the wound yarn.

In the meantime, in order to meet with the speeding up of the winding speed at 3,000 m/min or more, application of a spindle drive type yarn winding apparatus has been spreading. In a spindle drive type yarn winding apparatus, the control system may easily cause hunting even if the condition of a package surface is only slightly changed. As a result, defects may occur in the winding operation.

If such variations of pressing force or tension in the wound yarn, which cause the inward movement or uneveness of the wound yarn quality, are large, the wound yarn is broken. Accordingly, in this case, winding operation by the winding apparatus cannot be continued. Consequently, the winding operation is necessarily stopped.

Contrary to this, when the variations of pressing force or tension in the wound yarn are not large enough to break the wound yarn, the winding operation is continued. In this case although the yarn was not broken, since the yarn wound on the package has been subjected to the uneven tension as described above, the obtained yarn package may be defective. The defective yarn package may include a portion temporarily subjected to deformation of ribboning or inward movement due to excess variations of pressing force. The defective yarn package may also include a portion temporarily subjected to hunting. Thus, the quality of the wound yarn in the defective package may be uneven due to large variations of the tension in the wound yarn.

Since such a defective package is difficult to be detected by visual inspection of its appearance, it happens to be transferred to the subsequent process for a rewinding or weaving operation. In the subsequent process, there may occur a problem that the yarn cannot be smoothly withdrawn from the wound package due to portions having the deformation of ribboning or inward movement in the package. Alternatively, there may occur a problem of uneven dyability due to the portion subjected to hunting or the uneven quality in the wound yarn.

In the recent years, manufacture of yarn packages having a good unwinding ability and a good yarn quality is desired as the winding speed is enhanced and as the rate of automation in the subsequent process is increased. In order to satisfy the above described requirements, quality control in the yarn winding process becomes of importance.

At the same time, also in the yarn manufacturing process, the yarn processing speed is increasing and human labor has been minimized to decrease the manufacturing cost and to save human labor. In facilitating the speeding up or automation, it is indispensable to eliminate the problems of withdrawal or the problem of uneven dyability. The problems of withdrawal are caused by the deformation of ribboning or inward movement caused by the variations of pressing force or tension in the wound yarn, and the problem of uneven dyability is caused by the uneven quality.

In order to attending at the speeding up or to the minimization of human labor, automation of quality control and automatic selection of defective package in the yarn manufacturing process are becoming indispensable. Further, in order to meet with the speeding up of the winding speed, application of a spindle drive type yarn winding apparatus is increasing. The above-described deformation of ribboning or inward movement may easily occur in such a spindle drive type yarn winding apparatus, if the condition of a package surface is only slightly changed.

OBJECTS OF THE INVENTION

It is an object of the present invention to eliminate the problems inherent to the conventional winding technology. The present invention is intended to prevent defects, such as an unwinding defect or uneven dyability, from occurring in the subsequent process, by detecting variations in winding factor during the yarn winding process and thus by previously removing defective packages having deformation of ribboning, inward movement or uneveness in yarn quality. Further, according to the present invention, it is possible to take steps against abnormality in the winding apparatus or in the spinning apparatus or against inconveniences in the winding conditions or the spinning conditions at an early stage. In addition, it is still an object of the present invention to automate the winding process without human operator.

The term "winding factor" of the present invention means one of factors, such as tension in a winding yarn, a rotating speed of a contact roller pressed to a bobbin inserted onto a bobbin holder or yarn layer formed thereon and driven by said bobbin or yarn layer, or a rotating speed of a bobbin holder driven by a friction roller, which are controlled to be within a predetermined range during the winding operation and remains within a substantially constant range or varies in a previously programmed range during a normal winding operation, and which indicates a significant change upon a abnormal winding operation.

SUMMARY OF THE INVENTION

According to the present invention, the above-described objects are achieved by an apparatus for monitoring abnormality in a yarn winding apparatus, which is characterized by a means for previously setting a basic value of a winding factor, a means for detecting a present value of winding factor, a means for comparing the present value of winding factor detected by the winding factor detecting means with the basic value set by the basic value previously setting means, and a means for emitting an alarm signal wben the detected present value of winding factor exceeds more than a set range from the set basic value as a result of comparison i.n the comparing means.

According to the present invention, the present value of winding factor detected by the winding factor detecting means is compared with the basic value set by the basic value previously setting means in the comparing means, and an alarm signal is emitted by the alarm signal emitting means, when the detected present value of winding factor exceeds more than a set range from the set basic value as a result of comparison in the comparing means.

Therefore, the present invention can detect a yarn package including a portion temporary subjected to deformation of ribboning or inward movement due to excess variations of pressing force or uneveness in the wound yarn quality due to large variations of the tension in the wound yarn.

It should be noted that if the variations of pressing force or variations of the tension in the wound yarn are not so large, the wound yarn is not broken. Accordingly, it is difficult to detect a defective package from its appearance, and therefore, in a conventional winding step, such a package has been continued to be wound.

Contrary to this, according to the present invention, such a defective package is removed and is not transferred to the subsequent process. As a result, the packages transferred to the subsequent process are free from being defective. Accordingly, when the yarns are withdrawn from the packages in the subsequent process, a defect does not occur, which defect is often caused by the deformation of ribboning or inward movement or an uneven dyability due to the uneveness in the wound yarn.

Furthermore, it is possible to take steps against abnormality in the winding apparatus or the spinning apparatus or against inconveniences in the winding conditions or the spinning conditions at an early stage. Thus, it is possible to automate the winding process without human operator.

The present invention is especially advantageous for a spindle drive type yarn winding apparatus, wherein the speed of a bobbin holder is controlled based on the rotating speed of a contact roller or a spindle drive type yarn winding apparatus, wberein the speed of a bobbin holder is controlled based on tension in the wound yarn. The present invention is also applicable to a friction drive type winding apparatus wherein a bobbin inserted onto a bobbin holder or a yarn layer formed on the bobbin is in contact with a friction roller and is driven thereby.

According to the present invention, it is advantageous that the winding factor detecting means detects the changing direction and the rate of change of the present value of winding factor, and that in the comparing means, kind of abnormality is determined based on the changing direction and the rate of change of the winding factor.

When the the rotating speed of the contact roller or the bobbin holder is detected as the winding factor, it is preferred for the set range to be about ±0.1 to ±1% of the set speed for a thin yarn and about ±0.1 to ±3% of the set speed for a thick yarn in order to decrease uneven dyability of a yarn and to uniform percentage crimp and shrinkage percentage. When the tension in the wound yarn is detected as the winding factor, it is preferred for the set range to be about ±1 to ±3% of the set tension for a thin yarn and about ±1 to ±10% of the set tension for a thick yarn in order to decrease uneven dyability of a yarn and to uniform percentage crimp and shrinkage percentage.

BRIEF DESCRIPTION OF THE DRAWINGS

The present invention will now be explained in detail with reference to the accompanying drawings of embodiments of the present invention, wherein.

DESCRIPTION OF PREFERRED EMBODIMENTS

Figure 1:
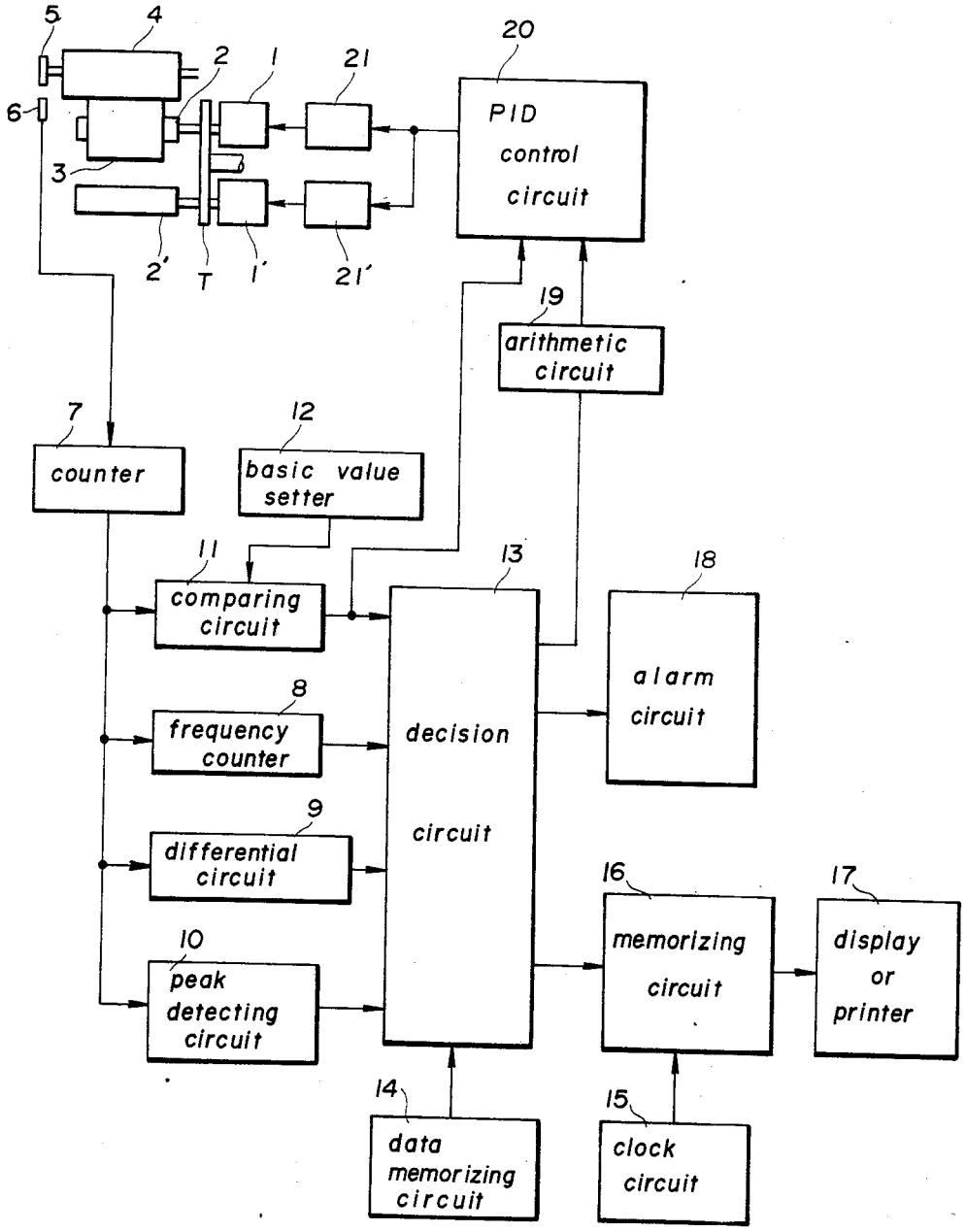
FIG. 1 is a block diagram of an embodiment of the present invention.

Referring to FIG. 1, which is a block diagram of the embodiment of the present invention wherein the rotating speed of a contact roller is detected as winding factor. The spindle drive type winding apparatus according to the present invention comprises a turret T turnably supported on a machine frame, bobbin holders 2 and 2' rotatably projecting from the turret T and connected to drive motors 1 and 1' so as to be driven by the drive motors 1 and 1', respectively, and a contact roller 4 contacting bobbins (not shown) inserted onto the bobbin holders 2 and 2' or a package formed thereon and driven thereby. The turret T is constructed in a manner similar to that in a conventionally known yarn winding apparatus of an automatic bobbin change type, and when the turret T is turned, the bobbin holder 2 or 2' is alternately located at a winding position and a standby position far from the winding position. When the bobbin holder 2 or 2' is located at the winding position, the bobbin inserted thereon or a yarn layer formed on the bobbin is in contact with the contact roller 4.

The winding apparatus of the present embodiment is provided with a traverse device wbich traverses a wound yarn along the bobbin as a conventionally known winding apparatus is though it is not illustrated in FIG. 1.

The contact roller 4 has a gear 5 for detecting the rotating speed integrally attached to an end thereof. A pulse pickup 6 is disposed near the gear 5 to detect the teeth of the gear 5 and emits pulse signals, the number of which for a predetermined sampling time interval are counted at a counter 7 so that the rotating speed of the contact roller 4 is directly and continuously measured. A means for detecting the rotating speed of the contact roller 4 is constructed as described above. Any conventionally known device for detecting the rotating speed, such as a rotary encoder, may be used in place of the gear 5.

The counter 7 samples the pulse signals, which are emitted from the pulse pickup 6 in synchronism with the rotation of the contact roller 4, at a predetermined time interval, and it inputs the obtained signal to a comparing means, which is connected to the counter 7 and which comprises a comparing circuit 11, a frequency counter 8, a differential circuit 9 and a peak detecting circuit 10.

The frequency counter 8 detects the frequency of the change in the rotating speed of the contact roller 4, which is detected by the rotating speed detecting means as the lapse of time, above or below the predetermined value. The frequency counter 8 inputs the detected signal to a decision circuit 13.

The differential circuit 9 calculates the changing direction, i.e., increase or decrease, and the inclination, i.e., the rate of change of the rotating speed of the contact roller 4 from the difference in the rotating speeds between that detected in the former sampling time interval and that detected in the present sampling interval subsequent to the former sampling time interval. The differential circuit 9 inputs the detected signals to the decision circuit 13.

The peak detecting circuit 10 detects the peak values, i.e., the maximum or minimum rotating speeds, when the rotating speed of the contact roller 4 changes. The peak detecting circuit 10 inputs the detected signals to the decision circuit 13.

The comparing circuit 11, the frequency counter 8, the differential circuit 9 and the peak detecting circuit 10 are synchronized with each other by means of a clock (not shown) in synchronism with the sampling time interval of the counter 7.

A basic value setter 12 is the means for previously setting a basic value of the present invention and is connected to the comparing circuit 11. The basic values of the contact roller 4 for the respective winding time intervals are previously set in the basic value setter 12 by means of a conventionally known method, such as through a keyboard or a dial, and the set basic values are sequentially input to the comparing circuit 11.

The comparing circuit 11 is the comparing means of the present invention, wherein the basic value of the contact roller 4 set by the basic value setter 12 is compared with the actually measured rotating speed of the contact roller 4 from the counter 7, and the difference between both the rotating speeds is input into the decision circuit 13 and, at the same time a feed-back signal of the winding speed is input into a PID, i.e., Proportional Integral and Differential, control circuit 20 to control the drive motors 1 and 1'.

The decision circuit 13 comprises a central processing unit, usually abridged as CPU. The decision circuit 13 matches the signals relating to the behaviors of the contact roller 4 with the signal input from a data memorizing circuit 14. The signals relating to the behaviors of the contact roller 4 are the frequency, the inclination and the direction of the speed change, and the peak value of the amplitude of the speed change, which are input from the frequency counter 8, the differential circuit 9, the peak detecting circuit 10 and the comparing circuit 11, respectively. The decision circuit 13 researches the causes by which the variation of the rotating speed of the contact roller 4 was generated. When the decision circuit 13 recognizes that any deviations have occurred, it outputs through an alarm circuit 18 signals regarding method to obviate the deviations, such as emission of an alarm signal, a signal for stopping the winding apparatus when the defect is significant or repeated, a signal for revolving tbe turret, a signal for altering the PID constants, or grading the package formed on the bobbin holder 2 or 2', and at the same time, it inputs the signals to a memorizing circuit 16.

The arithmetic circuit 19 alters the PID constants, i.e., the proportional constant, the integral constant and the differential constant, of the PID control circuit 20 so as to prevent hunting from occurring, when a hunting phenomenon is recognized in the rotation of the contact roller 4 by the decision circuit 13 from the rotating speed of the contact roller 4 detected by the pickup 6. The PID control circuit 20 operates inverter 21 or 21' so as to control the rotation of the drive motor 1 or 1'.

A data memorizing circuit 14 has been previously input with data relating to the behaviors of the contact roller 4 upon occurrence of various kinds of abnormalities in the winding apparatus, such as data relating to the winding patterns, data relating to the frequencies, the inclination or direction of the speed changes, and the peak values of the amplitudes of the variation, and statistical data relating to the causes occurring the abnormalities, methods to overcome the abnormalities, and the grading of the wound packages.

A clock circuit 15 measures the elapsed time after the start of the winding operation or the absolute time, and it inputs the time signal to the memorizing circuit 16 so as to apply the time to the data input to the memorizing circuit 16.

Reference numeral 17 designates a display unit or a printer. The output data from the data memorizing circuit 14 are displayed on the display unit or output from the printer continuously or upon receipt of the start signal.

When a yarn is wound by means of the winding apparatus illustrated in FIG. 1, the rotating speed of the drive motor 1 or 1', and accordingly, the rotating speed of the bobbin holder 2 or 2', is controlled so as to maintain the rotating speed of the contact roller 4 at a constant value or a previously programmed predetermined value.

During the winding operation, if the wind ratio nears a certain integer, ribboning may be formed on the surface of the package 3 formed on the bobbin inserted on the bobbin holder 2 or 2', and the ribboning may be deformed when its amount increases to a certain amount. Even if such deformation of the ribboning occurs, the wound yarn is not broken and the winding operation is continued when the amount of the ribboning is not so large, and accordingly when the variation of the tension in the wound yarn is not high. Since such a defective package is difficult to be detected from its appearance that it includes the above-described deformation of ribboning, it is often transferred to the subsequent process. In the subsequent process, there may occur problems due to the deformation of ribboning during withdrawal of the wound package for the purpose of rewinding, or there may occur uneven dyability due to the uneveness in the wound yarn.

Based on the earnest investigation conducted by the present inventor, it has been found that if the rotating speed of the contact roller 4 is continuously observed at every moment, the occurrence of deformation of ribboning can be detected from the speed change pattern.

Figure 2:
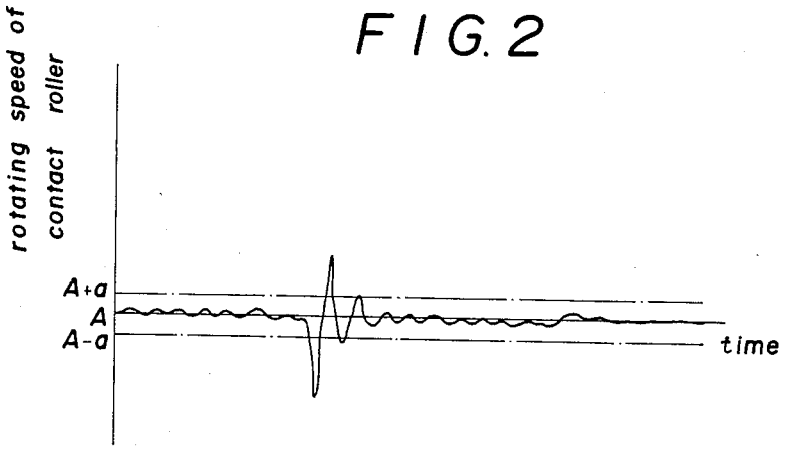
FIG. 2 is a diagram showing speed change of a contact roller upon occurrence of ribbon deformation, wherein time is plotted on abscissa and rotating speeds are plotted on ordinate.

More specifically, if ribboning formed on the surface of the package is deformed, the outer diameter of the package is decreased at once. Accordingly, the peripheral speed of the package is suddenly decreased due to the decrease of the outer diameter of the package beyond a certain range, which is designated by "−a", from a previously set rotating speed A. The certain range "−a" is set, for example, about −0.1 to −1.0% of the winding speed from the set rotating speed A for a thin yarn, or about −0.1 to −3.0% from the set rotating speed A for a thick yarn. Accordingly, the rotating speed of the contact roller 4, wbich is in contact with the package and is driven thereby, is suddenly decreased from the basic value A at a steep inclination, for example, more than 50 revolution/second, at the moment of occurrence of the ribbon deformation as illustrated in FIG. 2.

The counter 7 detects the rotating speed of the contact roller 4. The deviation is issued by comparing the detected rotating speed with the basic value transmitted from the basic value setter 12 in the comparing circuit 11, and it is fed-back to the PID control circuit 20. As a result, the rotating speed of the drive motor 1 or 1' is suddenly increased, and the rotating speed of the contact roller 4 is increased above the set value A. However, in this case, as long as the PID control circuit operates adequately, the rotating speed is again decreased after the peak, the absolute value of wbich is less than the absolute value of the peak occurred at the initial speed decrease.

Thus, according to the method for monitoring abnormality in a yarn winding apparatus of an automatic bobbin change type according to the present invention, the occurrence of abnormality of ribbon deformation can be detected from the changing direction and the changing ratio of the rotating speed of the contact roller 4.

Figure 3:
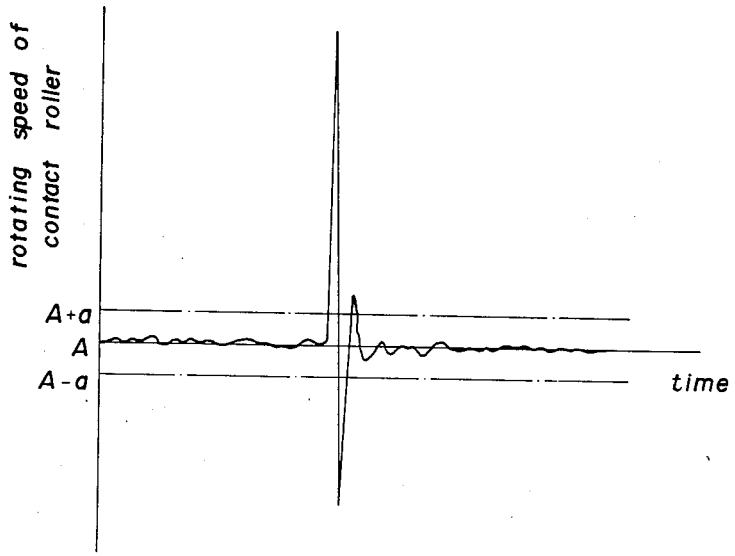
FIG. 3 is a diagram showing speed change of a contact roller upon occurrence of inward movement of the wound yarn, wherein time is plotted on abscissa and rotating speeds are plotted on ordinate.

Similarly, if there occurs inward movement of wound yarn, wherein the surface yarn layer, i.e., a part of the yarn package, formed on the bobbin moves toward the longitudinal center of bobbin due to variations of pressing force between the contact roller 4 and the yarn layer formed on the bobbin, the outer diameter of the package is increased at once, and accordingly, the peripheral speed of the package is suddenly increased. Thus, the rotating speed of the contact roller 4, which is in contact with the package and is driven thereby, is suddenly increased from the basic value A at a steep inclination, for example, more than 50 revolution/second as illustrated in FIG. 3.

The counter 7 detects the rotating speed of the contact roller 4. The deviation is issued by comparing the detected rotating speed with the basic value transmitted from the basic value setter 12 in the comparing circuit 11, and the deviation is fed-back to the PID control circuit 20. As a result, the rotating speed of the drive motor 1 or 1' is suddenly decreased, and the rotating speed of the contact roller 4 is decreased below the set value A. However, in this case, as long as the PID control circuit operates adequately, the rotating speed is again increased after the peak, the absolute value of which is less than the absolute value of the peak occurred at the initial speed decrease.

Thus, according to the method for monitoring abnormality in a yarn winding apparatus of automatic bobbin change type according to the present invention, the occurrence of abnormality of inward movement of the wound yarn can be detected from the changing direction and the changing ratio of the rotating speed of the contact roller 4.

Figure 4:
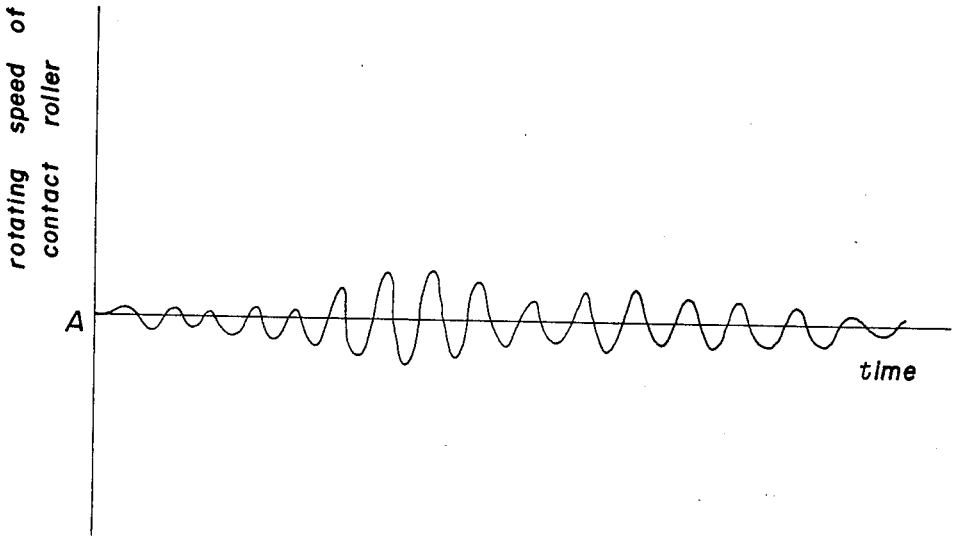
FIG. 4 is a diagram showing speed change of a contact roller upon occurrence of hunting in the control system, wherein time is plotted on abscissa and rotating speeds are plotted on ordinate.

Furthermore, in a spindle drive type yarn winding apparatus for high speed winding, hunting may easily occur in the control system (see FIG. 4), *if the condition* of a package surface is only slightly changed.

During the winding operation, if hunting occurs in the control system, the pressing force between the bobbin and the contact roller 4 may be varied or the tension in the wound yarn may be varied. However, if such variations in the pressing force or tension are not so large, the wound yarn is not broken, and the winding operation is continued. Since such a defective package is difficult to be detected from its appearance that it was subjected to such hunting, it is often transferred to the subsequent process. In the subsequent process, there may occur an uneven dyability due to the variations of the pressing force or tension during withdrawal of the wound package for the purpose of rewinding.

In the present invention, occurrence of hunting is detected from the speed change pattern from the continuous observation of the rotating speed of the contact roller at every moment in the winding process.

The counter 7 detects the rotating speed of the contact roller 4. The deviation is issued by comparing the detected rotating speed with the basic value transmitted from the basic value setter 12 in the comparing circuit 11, and it is fed-back to the PID control circuit 20. As a result, the rotating speed of the drive motor 1 or 1' is increased or decreased, and the rotating speed of the contact roller 4 is increased or decreased from the predetermined set value. However, in this case, as long as the PID control circuit operates adequately, the rotating speed is again decreased or increased after the peak, the absolute value of which is less than the absolute value of the peak occurred at the initial speed decrease or increase, and the rotating speed is finally converged to the previously set basic value.

However, if the setting of the control system is not adequate, the peripheral speed of the package is increased above or decreased below the predetermined range from the previously set rotating value due to hunting.

The predetermined range is, for example, about ±0.1 to ±1.0% of the winding speed from the set rotating speed A for a thin yarn, or about ±0.1 to ±3.0% from the set rotating speed A for a thick yarn.

Accordingly, the rotating speed of the contact roller 4, wbich is in contact with the package and is driven thereby, is fluctuated about the basic value A as illustrated in FIG. 2. In some cases, the rotating speed is converged as illustrated in FIG. 2 after fluctuation for a certain time interval, however, in some cases, the rotating speed is diverged.

Thus, according to the apparatus for monitoring abnormality in a spindle drive type yarn winding apparatus of the present invention, the occurrence of hunting in the control system can be detected by detecting the peak values and the frequency of the peak values of the rotating speed of the contact roller.

Based on the results, in the present embodiment, the turret T is turned so as to displace the bobbin holder, which has been located at the winding position, to the standby position, and new bobbin holder is moved to the winding position to continue the winding operation onto the new bobbin. Accordingly, if the defect was occasionally, similar defect does not occur again.

The obtained results are input into the alarm circuit 18, from which a signal is emitted to notify the occurrence of abnormality in the wound package, for example, warning lamp is lit.

The occurrence of the abnormality is also input into the memorizing circuit 16. The wound package is sorted and removed as a defective package, which includes the ribbon deformation or inward movement of the wound yarn, or which has been subjected to hunting, and the package is prevented from being transferred to the subsequent process for rewinding or weaving.

As a result, in the subsequent process, a defect upon withdrawal of the wound package or uneveness of yarn quality due to the deformation of ribboning or inward movement is prevented from occurring.

Furthermore, it is possible to determine from the comparison of the obtained data with the memorized data in the memorizing circuit wbether the defect was occasionally occurred or will be repeated. Taking these result into consideration, it is possible to take steps against abnormality in the winding apparatus or the spinning apparatus or against inconveniences in the winding conditions or the spinning conditions at an early stage. Thus, it is possible to automate the winding process without human operator.

The above explanation has been done with reference to a peripheral speed control winding apparatus of an automatic change turret type, the present invention is also applicable other peripheral speed control type winding apparatuses wherein the rotating speed of the bobbin holder is detected by means of a contact roller which is rotated in contact with a bobbin or a yarn layer formed on the bobbin.

When the present invention is carried out in a multi cop winding apparatus, wherein a plurality of bobbins are inserted onto a spindle, a common contact roller may be disposed for a plurality of bobbins to detect their rotating speed.

Furthermore, the present invention is also applicable to a spindle drive type yarn winding apparatus of tension control type, wherein precision for detecting abnormality can be enhanced by utilizing variations in rotating speed of a contact roller regardless of tension variations due to the change of Young's modulus of the yarn or tension variations due to traverse motion.

Figure 5:
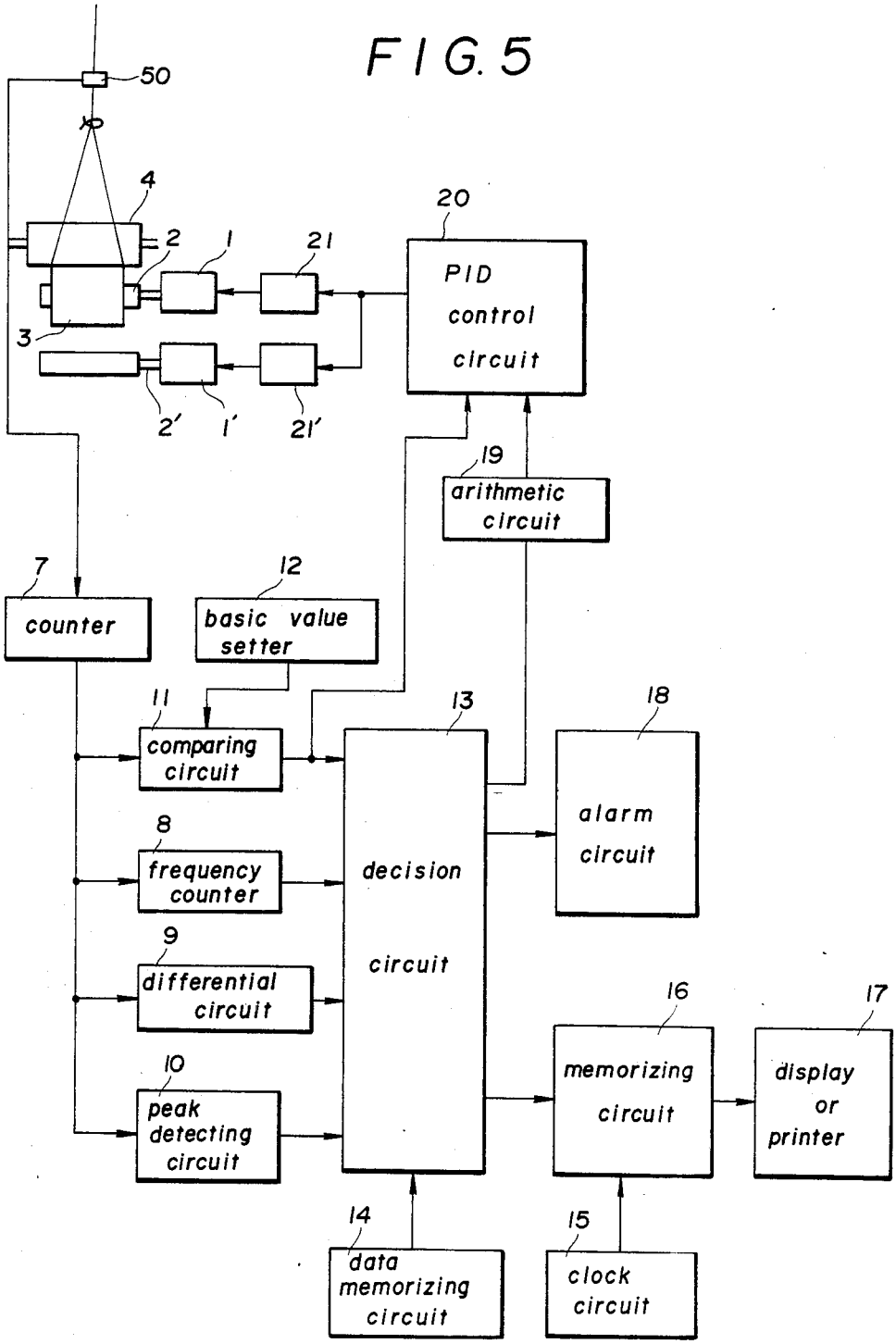
FIG. 5 is a block diagram of another embodiment of the present invention.

FIG. 5 is a block diagram of another embodiment of the present invention. This embodiment is a spindle drive type winding apparatus similar to that illustrated in FIG. 1, and accordingly, similar parts are designated by the same reference numerals as those used in FIG. 1, and their further explanation is omitted here.

When a yarn is wound by means of the winding apparatus illustrated in FIG. 5, the rotating speed of the drive motor 1 or 1', and accordingly, the rotating speed of the bobbin holder 2 or 2', is controlled so as to maintain the tension in the wound yarn at a constant value or a previously set predetermined value. For this purpose, a tension detector 50 of a conventionally known type is disposed along the yarn passage.

The tension detector 50 detects the tension in the yarn and emits analog signals or digital signals, i.e., pulses. When analog signals are emitted, they are transformed into pulses by means of an A/D converter, i.e., analog digital converter. When digital signals are directly used, the tension detector 50 is so adjusted that pulses are emitted only when the tension exceeds the predetermined range. Then the number of the pulses are counted by a counter 7 for a predetermined sampling time interval, so that the tension in the wound yarn is directly and continuously detected.

Accordingly, this embodiment is different from the first embodiment in that signals based on tension in the yarn is processed in this embodiment while signals based on the rotating speed of the contact roller is processed in the above-described first embodiment.

According to the present embodiment, the occurrence of deformation of ribboning can be detected from the tension change pattern if the tension in the wound yarn is continuously observed at every moment.

More specifically, if ribboning formed on the surface of the package is deformed, the outer diameter of the package is decreased at once, and accordingly, the tension in the wound yarn is suddenly decreased due to the decrease of the outer diameter of the package beyond a certain range from a previously set rotating tension. The certain range is set, for example, about −1 to −3% of the set tension for a thin yarn, or about −1 to −10% of the set tension for a thick yarn. Accordingly, the tension wound onto the package is suddenly decreased from the basic value at a steep inclination at the moment of occurrence of the ribbon deformation as illustrated.

The counter 7 detects the tension in the wound yarn. The deviation is issued by comparing the detected tension with the basic value transmitted from the basic value setter 12 in the comparing circuit 11, and it is fed-back to the PID control circuit 20. As a result, the rotating speed of the drive motor 1 or 1' is suddenly increased, and the rotating speed of the contact roller 4 is increased above the set value, and thus the tension in the yarn is also increased. However, in this case, as long as the PID control circuit operates adequately, the rotating speed is again decreased after the peak, the absolute value of which is less than the absolute value of the peak occurred at the initial speed decrease, similarly the tension in the yarn is decreased.

Thus, according to the apparatus for monitoring abnormality in a tension control type yarn winding apparatus of this embodiment, the occurrence of abnormality of ribbon deformation can be detected from the changing direction and the changing ratio of the tension in the wound yarn.

Similarly, if there occurs inward movement of wound yarn, wherein the surface yarn layer, i.e., a part of the yarn package, formed on the bobbin moves toward the longitudinal center of bobbin due to variations of pressing force between the contact roller and the yarn layer formed on the bobbin, the outer diameter of the package is increase at once, and accordingly, the peripheral speed of the package is suddenly increased. Thus, the tension in the yarn wound onto the package is suddenly increased from the basic value at a steep inclination.

The counter 7 detects the tension in the wound yarn. The deviation is issued by comparing the detected tension in the wound yarn with the basic value transmitted from the basic value setter 12 in the comparing circuit 11, and the deviation is fed-back to the PID control circuit 20. As a result, the rotating speed of the drive motor 1 or 1' is suddenly decreased, and the tension in the wound yarn is decreased below the set value. However, in this case, as long as the PID control circuit operates adequately, the rotating speed is again increased after the peak, the absolute value of which is less than the absolute value of the peak occurred at the initial speed decrease, and the tension in the wound yarn is increased.

Thus, according to the apparatus for monitoring abnormality in a tension control type yarn winding apparatus of the present embodiment, the occurrence of abnormality of inward movement of the wound yarn can be detected from the changing direction and the changing ratio of the tension in the wound yarn.

Furthermore, occurrence of hunting in a spindle drive type yarn winding for a high speed winding can be identified by detecting the peak values and frequency of peak values of the tension in the wound yarn.

The obtained results are input into the alarm circuit 18 similar to the first embodiment, and the occurrence of abnormalities is input into the memorizing circuit. Then the steps similar to those taken in the first embodiment, i.e., emission of alarm signal, sort and removal of defective packages, are carried out.

The above explanation has been conducted with reference to a spindle drive type winding apparatus wherein the speed of the bobbin holder is controlled based on the rotating speed of the contact roller. However, the present invention is also applicable to a friction drive type winding apparatus wberein a bobbin inserted onto a bobbin holder and a friction roller are pressed to each other, and the bobbin holder is driven by the friction roller. An embodiment of this type is illustrated in FIG. 6, wherein parts similar to those illustrated in FIGS. 1 and 5 are designated by the same reference numerals, and their further explanations is omitted here.

Figure 6:
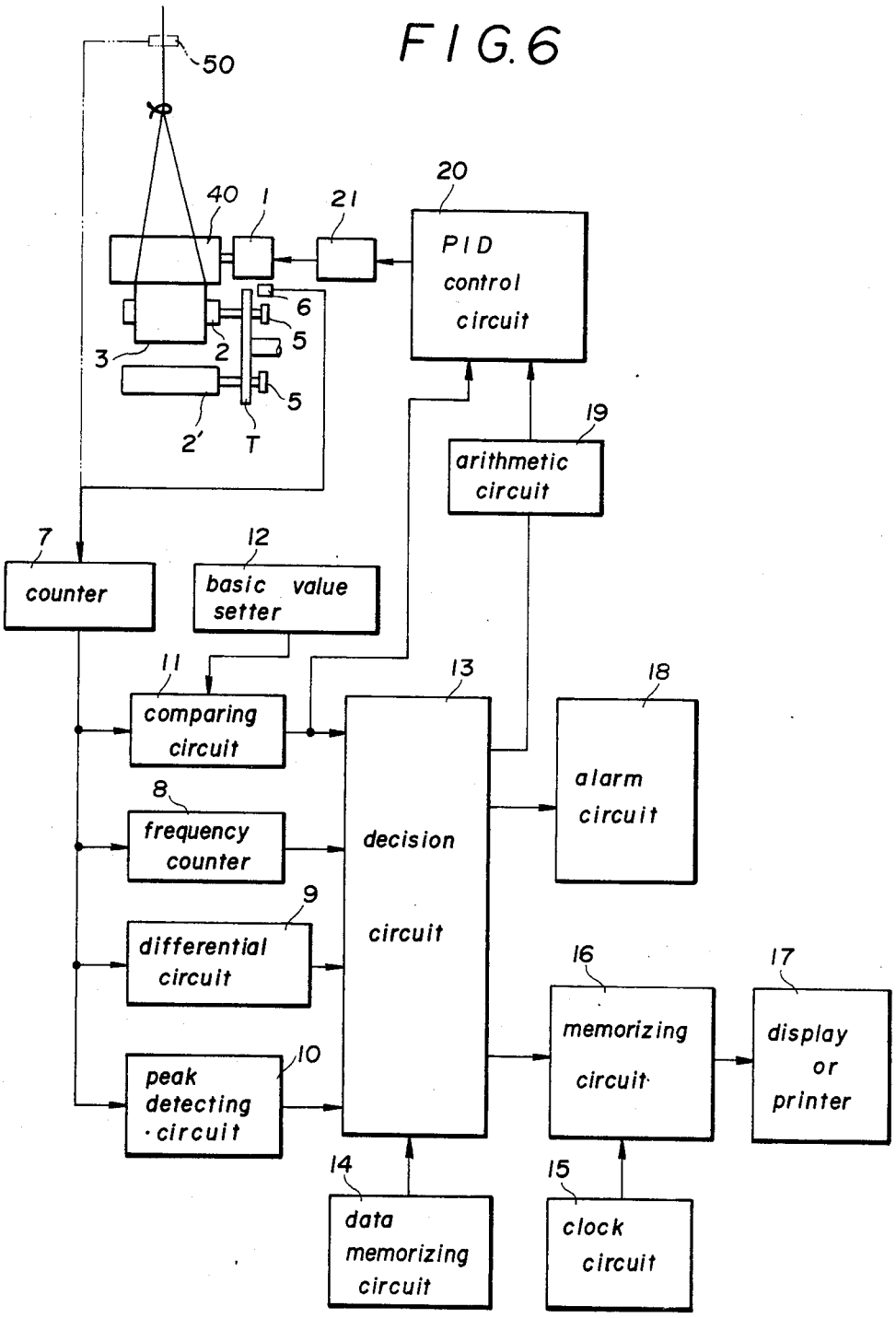
FIG. 6 is a block diagram of still further embodiment of the present invention.

In the embodiment illustrated in FIG. 6, since one of bobbin holders 2 and 2' is driven by a friction roller 40, the bobbin holders 2 and 2' have gears 5 attached to one ends thereof as the contact roller illustrated in FIG. 1 does. A pickup 6 is disposed to detect teeth of the gears 5.

The rotating speed of the bobbin holder 2 or 2' is detected by the gear 5 and the pickup 6 and is processed in a manner similar to that for processing the rotating speed of the contact roller illustrated in FIG. 1 so that the yarn winding speed is maintained at a substantially constant speed. As a result, the friction roller 40 is controlled by a PID control circuit via an inverter at a predetermined speed, and the occurrence of defects, such as deformation of ribboning, inward movement of the wound yarn and hunting, is detected and the defective packages are processed in a manner similar to that for the embodiment illustrated in FIG. 1.

Further, also in a friction type winding apparatus, a tension detector 50 may be disposed as illustrated by a dot and dash line in FIG. 6 in place of the gear 5 and the pickup 6. The rotating speed of the friction roller 40 may be controlled by a PID control circuit in stead of the bobbin holder of the embodiment illustrated in FIG. 5, and the occurrence of defects, such as deformation of ribboning, inward movement of the wound yarn and hunting, may detected and the defective packages are processed in a manner similar to that for the embodiment illustrated in FIG. 5.

In a friction type winding apparatus provided with a contact roller, which is pressed to a bobbin inserted onto a bobbin holder to detect the rotating speed of the bobbin holder, in addition to a friction roller, it is preferred that the contact roller has a gear attached to one end thereof like the embodiment illustrated in FIG. 1 and that teeth of the gear is detected by means of a pickup so as to control the rotating speed of the friction roller in a manner similar to that for the embodiment illustrated in FIG. 6. Thus, the occurrence of defects, such as deformation of ribboning, inward movement of the wound yarn and hunting, are detected and the defective packages are removed.

According to the present invention, defective packages having deformation of ribboning, inward movement or uneveness in yarn quality are removed at an early stage by detecting variations in winding factor during yarn winding process. Accordingly, defects, such as a defect upon unwinding or uneven dyability, are prevented from occurring in the subsequent process. Further, according to the present invention, it is possible to take steps against abnormality in the winding apparatus or the spinning apparatus or against inconveniences in the winding conditions or the spinning conditions at an early stage and to automate the winding process without human operator.

What is claimed is:

1. An apparatus for monitoring abnormality in a yarn winding apparatus, comprising means for previously setting a basic value of a winding factor, means for detecting a present value of said winding factor, means for comparing said present value of said winding factor detected by said winding factor detecting means with said basic value set by said basic value previously setting means, means for discriminating a change in a pattern of said winding factor when said detected present value of said winding factor exceeds more than a set range from said set basic value as a result of comparison in said comparing means, and means for emitting an alarm signal in accordance with the discriminated changed pattern.

2. The apparatus for monitoring abnormality in a yarn winding apparatus according to claim 1, wherein said detecting means includes means for detecting a changing direction and a rate of change of said present value of said winding factor, and said comparing means determines a type of abnormality based on said changing direction and said rate of change of said present value of said winding factor.

3. The apparatus for monitoring abnormality in a yarn winding apparatus according to claim 1 or 2, wherein said yarn winding apparatus is a yarn winding apparatus of an automatic bobbin change type comprising a plurality of rotatable bobbin holders onto which bobbins for winding a yarn are inserted, a turret for alternately moving said bobbin holders between a winding position and a standby position, and a contact roller which is rotated in contact with said bobbin inserted onto said bobbin holder located at said winding position or a yarn layer formed on said bobbin, which apparatus includes a means for detecting said present value of said winding factor and for moving said turret so as to change said bobbins when said detected value exceeds more than said set range from said set value.

4. The apparatus for monitoring abnormality in a yarn winding apparatus according to claim 1, wherein said winding factor is a rotating speed of a contact roller which is rotated in contact with a yarn layer formed on a bobbin.

5. The apparatus for monitoring abnormality in a yarn winding apparatus according to claim 4, wherein said winding apparatus is a spindle drive type winding apparatus in which the rotating speed of a bobbin holder is controlled based on said rotating speed of said contact roller.

6. The apparatus for monitoring abnormality in a yarn winding apparatus according to claim 5, wherein said spindle drive type yarn winding apparatus comprises a bobbin holder onto which a bobbin for winding a yarn is inserted and which is drivingly rotated, and a contact roller which is rotated in contact with said bobbin inserted onto said bobbin holder or a yarn layer formed on said bobbin and which controls the rotating speed of said bobbin holder, which apparatus is characterized by a means for previously setting a basic value of said contact roller, a means for detecting a rotating speed of said contact roller, a means for comparing said rotating speed of said contact roller detected by said rotating speed detecting means with said basic value set by said basic value previously setting means, and a means for detecting peak values and a frequency of the peak values when said detected rotating speed exceeds more than said set range from said set basic value as a result of comparison in said comparing means, whereby the occurrence of hunting in the winding control system is detected based on said peak values and said frequency of the peak values.

7. The apparatus for monitoring abnormality in a yarn winding apparatus according to claim 4, wherein said winding apparatus is a friction drive type winding apparatus in which a bobbin holder and a friction roller are pressed to each other, and said bobbin holder is driven by said friction roller.

8. The apparatus for monitoring abnormality in a yarn winding apparatus according to claim 1, wberein said winding apparatus is a friction drive type winding apparatus in which a bobbin holder and a friction roller are pressed to each other, and said bobbin holder is driven by said friction roller, and said winding factor is a rotating speed of a bobbin which is rotated in contact with said friction roller.

9. The apparatus for monitoring abnormality in a yarn winding apparatus according to claim 1, wherein said winding factor is tension in a yarn wound onto a bobbin.

10. The apparatus for monitoring abnormality in a tension control type yarn winding apparatus according to claim 9, wherein said winding apparatus is a spindle drive type winding apparatus in which the speed of said bobbin holder is controlled based on said tension in said wound yarn.

11. The apparatus for monitoring abnormality in a tension control type yarn winding apparatus according to claim 9, wherein said winding apparatus is a friction drive type winding apparatus in which a bobbin holder and a friction roller are pressed to each other, and said bobbin holder is driven by said friction roller.

* * * * *